United States Patent [19]

Nyssen

[11] 4,160,312

[45] Jul. 10, 1979

[54] METHOD AND APPARATUS FOR MAKING MULTI-LAYER SPIRAL PIPE

[76] Inventor: James Nyssen, 10045 Kenswood Dr., Chilliwack, British Columbia, Canada

[21] Appl. No.: 867,139

[22] Filed: Jan. 5, 1978

[51] Int. Cl.[2] ..... B23P 19/00; B23P 19/04

[52] U.S. Cl. ..... 29/429; 29/509; 29/781; 72/50; 138/150

[58] Field of Search ..... 29/429, 781, 505, 509; 138/150, 154; 72/49, 50

[56] References Cited

U.S. PATENT DOCUMENTS

| | | | |
|---|---|---|---|
| 3,263,321 | 8/1966 | Lombardi | 29/781 X |
| 3,474,514 | 10/1969 | Lombardi | 29/429 X |
| 3,487,537 | 1/1970 | Lombardi | 29/429 X |
| 3,694,892 | 10/1972 | Hale | 29/429 |

*Primary Examiner*—Charlie T. Moon
*Attorney, Agent, or Firm*—Lee & Smith

[57] ABSTRACT

An apparatus and method for continuously forming multi-layer metal pipe from at least two elongated sheets of metal. One sheet is impressed with longitudinal corrugations in a rolling device and the second sheet, being uncorrugated, is then positioned contiguously upon the first, forming a multi-layer sheet. One or more removable modules is mounted in the rolling device to accurately align and guide the second sheet into position upon the first. Complementary portions of a single corrugation are then formed in the marginal edges of the multi-layer sheet and the sheet is spiralled into adjacent, helical convolutions in a pipe forming device, with the uncorrugated sheet forming the pipe interior. The adjacent convolutions are joined in a helical seam in the single corrugation by a seaming device located in the pipe forming device. In the primary embodiment of the invention, the seam is formed as a double lock seam along a neutral axis of the single corrugation.

14 Claims, 9 Drawing Figures

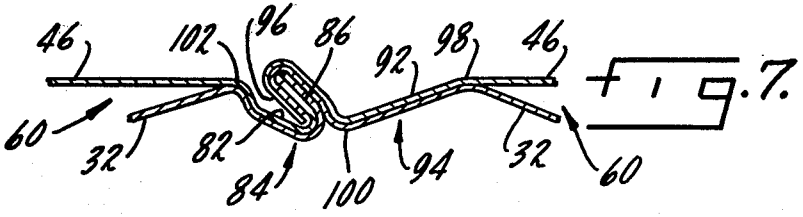
FIG. 7.
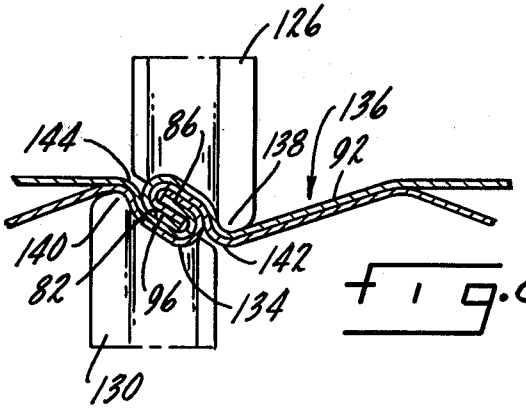
FIG. 8.
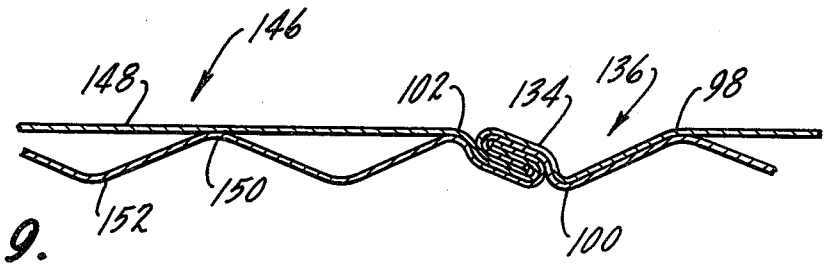
FIG. 9.
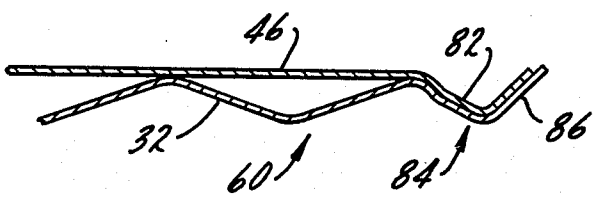
FIG. 4.
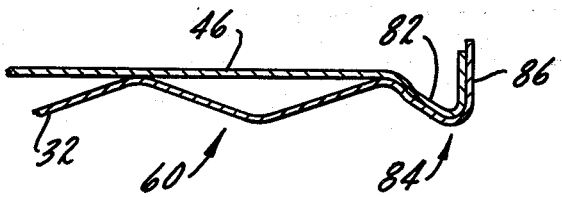
FIG. 5.
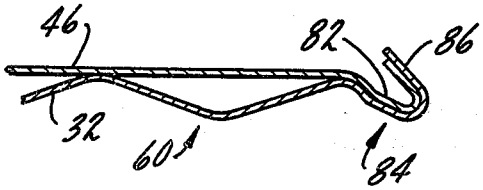
FIG. 6.
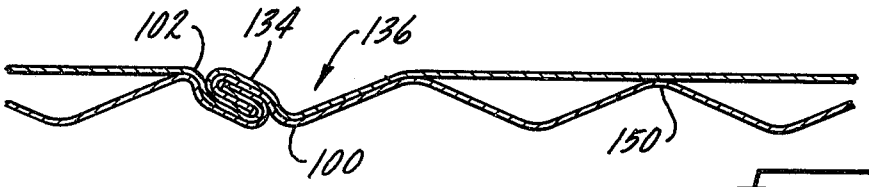

METHOD AND APPARATUS FOR MAKING MULTI-LAYER SPIRAL PIPE

SUMMARY OF THE INVENTION

The Background

This invention relates to a method and apparatus for continuously forming spirally wound multi-layer metal pipe. The invention relates more particularly to a method and apparatus for constructing a spiral pipe of two or more pipe wall thicknesses, the inner wall of the pipe being generally smooth with the exception of a single helical corrugation, and the outer wall of the pipe being corrugated.

Apparatus for forming spiral pipe from one or more elongated sheets of metal or other ductile material is well known. Such apparatus is illustrated, for example, in U.S. Pat. Nos. 1,659,754; 2,752,873; 3,093,103; 3,269,162; and 3,606,783. Apparatus for manufacture of multi-layer spiral pipe is illustrated in U.S. Pat. Nos. 3,263,321; 3,474,514; 3,487,537 and 3,694,892.

In a conventional apparatus for producing spirally corrugated pipe with a single wall, an elongated sheet of metal is impressed with longitudinal corrugation and then spiralled into ajacent, helical convolutions which are joined either by welding or by formation of a continuous lock seam. One such apparatus for forming a spirally wound pipe is illustrated in the applicant's U.S. Pat. No. 4,070,886 entitled "Spiral Pipe Forming Machine With Device For Aligning Spiralling Rolls," formerly U.S. patent application Ser. No. 756,766, filed Jan. 5, 1977.

Spiral pipe produced by such apparatus, although exhibiting sufficient load bearing capacity to be used as a drainage culvert for highways and the like, suffers the disadvantage of having a corrugated inner wall. Exemplary is the helically corrugated pipe produced by the apparatus of the applicant's above-identified patent and also Freeze U.S. Pat. No. 2,136,943. The result of a non-smooth inner wall is inhibition to flow of liquids through the pipe, forcing the pipe user to select a larger pipe diameter than would be needed if the inner wall of the pipe were smooth.

The prior art has recognized the strength advantages of a corrugated pipe in combination with a smooth inner wall. For example, Lombardi U.S. Pat. Nos. 3,340,901 and 3,474,514 have disclosed a spiral pipe product and apparatus for forming the pipe from at least two layers of metal including a corrugated pipe outer shell and a smooth pipe inner shell. Adjacent pipe convolutions are joined by a flat seam extending along a valley of the outer pipe shell, thereby leaving a smooth inner pipe wall.

Although the Lombardi pipe solves the flow problems of pipe having a corrugated pipe inner wall, the Lombardi pipe suffers the disadvantage of having a relatively weak seam joining adjacent convolutions of the pipe. It is well known that stressive forces inherent in a spirally wound pipe and experienced by the pipe when buried beneath the earth tend to buckle and weaken the flat seam of the Lombardi pipe, requiring the pipe maker to employ greater thicknesses of pipe material than otherwise would be necessary in order to obtain sufficient strength for the pipe seam.

The strongest position for location of the seam in a single thickness helically corrugated pipe is along a flank or neutral axis between a hill and valley of one of the helical pipe corrugations. Exemplary is Fay et al U.S. Pat. No. 2,282,176. Stressive forces are experienced by the corrugated pipe on a line running between the corrugation hill and valley, tending to compress or extend the seam at its strongest point. Fay, however, suffers the disadvantage of producing a spirally wound pipe having a non-smooth inner wall.

The Invention

The above disadvantages of the prior art and others are overcome by the present invention which provides a method and apparatus for producing a multi-layer, spirally wound pipe having a generally smooth inner wall and corrugated outer wall. The inner wall has a single corrugation in which the helical seam of adjacent pipe convolutions is located along a neutral axis.

The apparatus includes a roll forming device for positioning of two or more sheets in contiguous layers and driving the sheets into a pipe forming device which accepts the sheets and spirals the layered sheets into successive, adjacent helical convolutions having a central axis formed at an oblique angle to the longitudinal axis of the layered sheets. A seaming device in the pipe forming device joins adjacent pipe convolutions.

In the roll forming device, the apparatus includes a rolling means for impressing continuous longitudinal corrugations in one of the elongated sheets which later forms the exterior of the pipe. The roll forming device also includes a second means for positioning a second, uncorrugated sheet in a contiguous layer upon the first sheet, forming a multi-layer sheet, with the edges of the two sheets being generally coextensive.

Subsequent to formation of the multi-layer sheet, the apparatus includes an additional device for forming complementary portions of a single, helical corrugation in the inner wall of the pipe. The device comprises a first rolling means adjacent one marginal edge of the multi-layer sheet to shape therein a first portion of the single corrugation. Second rolling means is located adjacent the other marginal edge of the multi-layer sheet to shape a second portion of the single corrugation complementary to the first. The first and second portions are joined by the seaming device to form the single inner corrugation.

Since the corrugation portions are formed in the multi-layer sheet, the single corrugation is formed in the inner wall of the pipe contiguous with one of the helical corrugations in the outer wall of the pipe. Therefore, in effect, this portion of the pipe is a double thickness corrugated pipe having a common corrugation, whereas the remainder of the pipe has a corrugated exterior and a smooth interior.

In the preferred embodiment of the invention, the first and second rolling means for formation of the complementary portions of the single corrugation also include rolling means to form partial lock seam elements in the marginal edges of the multi-layer sheet along the first and second portions of the single corrugation. The lock seam elements are appropriately located so that when the seaming device completes the lock seam, the lock seam elements are formed into a double lock seam located on a neutral axis of the single corrugation.

Preferably, the second means in the roll forming device for positioning the second flat sheet upon the first includes at least one removable module mounted in the roll forming device to accurately align and guide the second sheet into position upon the first. Each module is composed of a framework having mounted therein a pair of elongated pinch rolls positioned on opposite sides of the second sheet and a pair of edge guide rolls positioned at opposite edges of the second sheet, the pinch and guide rolls cooperating to maintain the second sheet vertically and laterally stable.

BRIEF DESCRIPTION OF THE DRAWINGS

The invention will be described in greater detail with reference to the drawings, in which:

FIGS. 4 through 6 illustrate successive steps of forming a portion of the single corrugation in one marginal edge of a multi-layer sheet and also forming, at the same time, a lock seam element, FIG. 7 illustrates interengagement of opposed lock seam elements formed in opposite marginal edges of the multi-layer sheet after curling the sheet into adjacent convolutions but prior to completion of the lock seam, FIG. 8 illustrates completion of the lock seam by closing the lock seam elements to form a double lock seam along the neutral axis of the single corrugation, and FIG. 9 is a broken cross-sectional illustration of a portion of a pipe product formed by the apparatus of the invention.

DETAILED DESCRIPTION OF THE INVENTION

Figure 1:
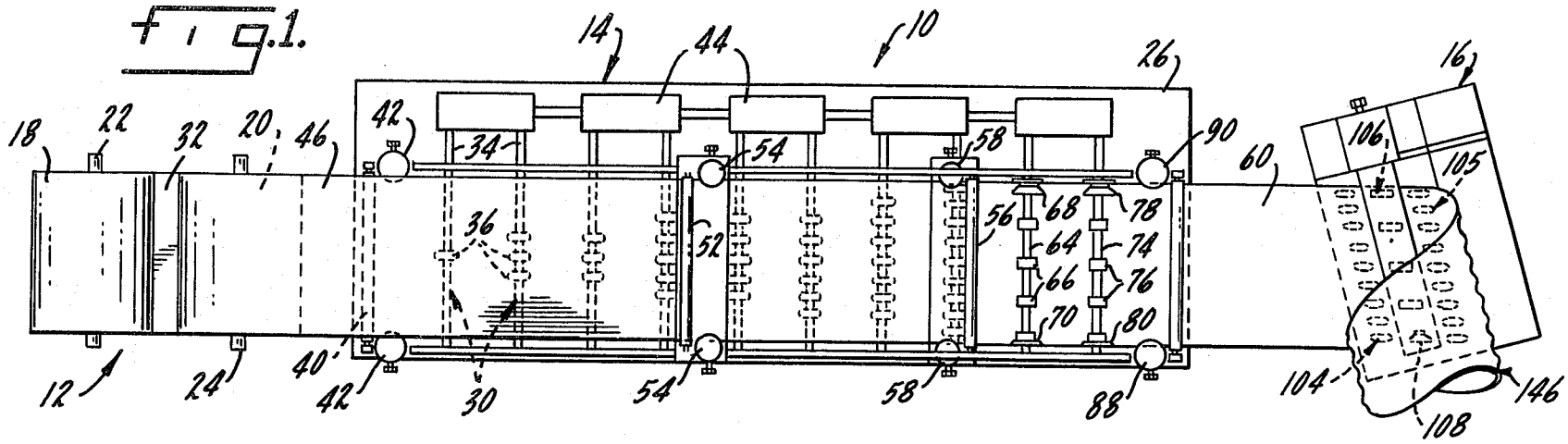
FIG. 1 is a top plan schematic illustration of a pipe forming apparatus according to the invention.
Figure 2:
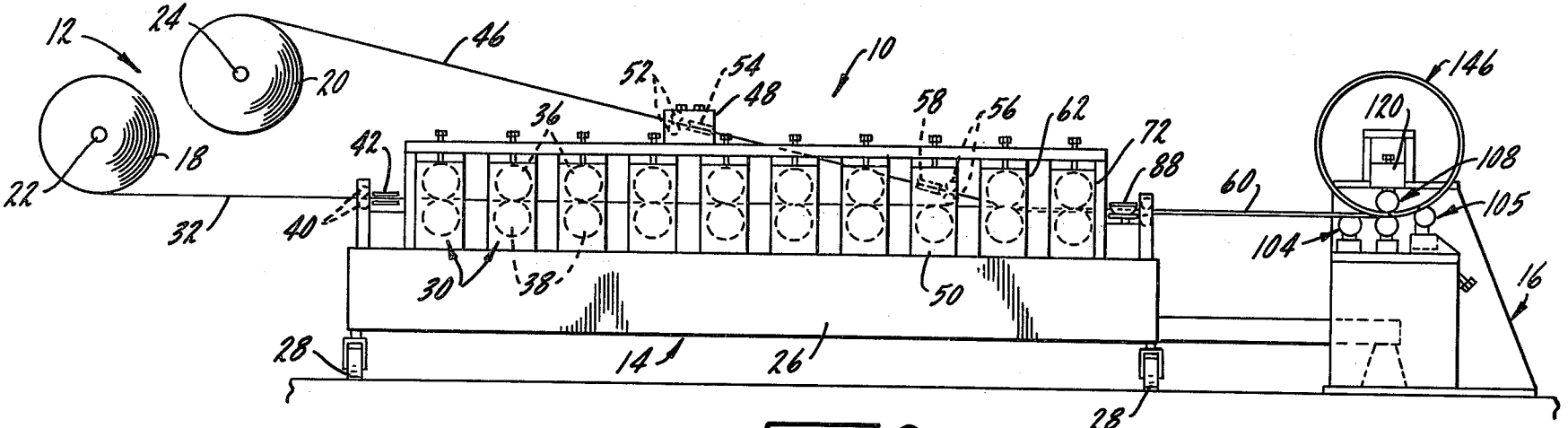
FIG. 2 is a side elevational illustration of the apparatus illustrated in FIG. 1.

Turning now to the drawings, and in particular FIGS. 1 and 2, the apparatus according to the invention is generally designated 10. The apparatus illustrated is composed of a decoiling device 12, a corrugating or roll forming device 14 and a multiple roll pipe forming device 16. Apparatus not illustrated, but utilized in combination with the illustrated apparatus, as one skilled in the art will appreciate, is a flying cut-off device, such as that illustrated in the applicant's U.S. Pat. No. 3,815,455, for sequentially severing predetermined lengths of pipe emerging from the multiple roll pipe forming device 16.

The decoiling device 12, as schematically illustrated, includes a coiled first continuous sheet 18 and a coiled second continuous sheet 20. The coils 18 and 20 are respectively mounted on central spindles or axles 22 and 24. Although not illustrated for the sake of simplicity of drawing FIGS. 1 and 2, each of the spindles 22 and 24 would be mounted in an appropriate framework to maintain the coils 18 and 20 in the positions indicated.

The corrugating device 14 consists of a carriage 26 mounted for pivoting relative to the multiple roll pipe forming device 16 on a plurality of wheels 28. A series of corrugating rolls 30 are mounted on the carriage 26 for successively forming longitudinal corrugations in a first sheet of metal 32 as it emanates from the first coil 18 and passes through the corrugating device (from left to right in FIGS. 1 and 2). As is well known in the art, each of the corrugating rolls 30 comprises a complementary pair of rolls designated a stand, composed of an upper roll having a shaft 34 with one or more impressing rollers 36 mounted thereon, and a lower roll 38 which complements the structure of the upper roll to form longitudinal corrugations in the first elongated sheet of metal as it passes through the corrugating carriage. A pair of pinch rolls 40 and a pair of edge guide rolls 42 align the first sheet 32 as it enters the corrugating device 14.

Each of the stands of corrugating rolls 30 is provided motive power by a gear drive box 44. As illustrated, each of the gear boxes 44 is connected for direct drive to a preceding gear box, and a motive source (not illustrated) is connected to one of the gear boxes 44 to drive the five illustrated gear boxes in unison. Normally, the motive source is mounted in the interior of the carriage 26.

A second elongated sheet of metal 46 emanates from the second coil 20. As shown, the sheet 46 proceeds through a pair of guide modules 48 and 50 which align the second sheet and position it in a contiguous layer upon the first sheet 32 as illustrated. Each of the modules 48 and 50 is removable from the carriage 26, each being bolted or otherwise affixed to the framework of the carriage. The guide module 48 is composed of a pair of pinch rolls 52 located on opposite sides of the sheet 46 and a pair of adjustable edge guide rollers 54 located on opposite edges of the sheet. Likewise, the guide module 50 includes a pair of pinch rolls 56 located on opposite sides of the sheet 46 and a pair of adjustable edge guide rollers 58 located at opposite edges of the sheet.

The module 50 guides the sheet 46 into contiguous abutment with the now-corrugated sheet 32 to form a multi-layer sheet 60 at the second to last stand 62 located on the carriage 26. The stand 62 includes a top shaft 64 having a plurality of flat rollers 66 which bear upon the top surface of the sheet 46. Likewise, and not illustrated in detail, the stand 62 also includes a bottom shaft having a plurality of rollers shaped to engage the underside surfaces of the hills of the corrugations in the corrugated sheet 32.

As illustrated, the top shaft 64 also carries, looking in the direction of travel of the sheet 60, a left outboard roller 68 and a right outboard roller 70. The purpose of the rollers 68 and 70 is to initiate formation of complementary portions of a single corrugation in the marginal edges of the multi-layer sheet 60. Rollers conforming to the shape of the rollers 68 and 70 are mounted on a lower shaft of the stand 62 to complement the functions of the rollers 68 and 70 in formation of the portions of the single corrugation.

Similar to the stand 62, the carriage 26 includes a final stand 72 having a top shaft 74 carrying a plurality of flat rollers 76 and a left outboard roller 78 and a right outboard roller 80.

In the preferred embodiment of the invention, the rollers 68, 70, 78 and 80 shape complementary portions of a single corrugation in the multi-layer sheet 60 and also form partial lock seam elements in the marginal edges of the multi-layer sheet which are later engaged and the lock seam completed by a seaming apparatus located in the pipe forming device. As best shown in FIG. 4, a partial profile of the right-hand portion of the multi-layer sheet 60 is illustrated immediately subsequent to passing through the stand 62. As shown, the sheet 46 lies upon the sheet 32. A portion 82 of a single corrugation has been formed in the right margin 84 of the sheet 60 by the roller 70 (FIG. 1). Also partially formed in the right margin 84 is a flange 86 of a lock seam element.

In FIG. 5, a partial profile of the sheet 60 is illustrated immediately subsequent to passing through the stand 72.

In this figure, the flange 86 of the lock seam element has been further bent by the roller 80 to an upright position.

Finally, in FIG. 6, the flange 86 of the lock seam element is shown bent over the portion 82 of the single corrugation to approximately 45° to the vertical. Bending of the flange 86 is accomplished by an edge roller 88 (FIG. 1) located downstream on the carriage 26 from the stand 72.

Only the right-hand portion of the sheet 60 and formation of the portion 82 and flange 86 in the right margin 84 are illustrated in FIGS. 4–6. In a like manner, at the same time a second portion of the single corrugation is being formed in the left margin of the sheet 60 by the rollers 68 and 78 and an edge roller 90 which serves the same function as the edge roller 88; that is, to form the lock seam element on the left margin of the sheet over to an angle approximately 45° to the vertical.

Turning to FIG. 7, illustrated is engagement of the corrugation portion 82 and flange 86 formed in the right margin 84 of the sheet 60 with a second corrugation portion 92 which has been formed in the left margin 94 of the sheet. As shown, the portion of the sheet 60 carrying the left margin 94 has been curled into a single convolution by the pipe forming device 16 and a flange 96 of a lock seam element formed on the left margin 94 has engaged the flange 86 of the lock seam element formed on the right margin 84, just prior to closing of the lock seam in the pipe forming device 16. As illustrated, the corrugation portion 92 is significantly larger than the corrugation portion 82, the portion 92 comprising over half of a corrugation and including a hill 98 and a valley 100, whereas the corrugation portion 82 comprises less than half of a corrugation and includes only a hill 102 of the complete corrugation. The purpose of forming the proportionate sizes of the corrugation portions 82 and 92 is to assure location of the lock seam formed by the interengaged flanges 86 and 96 on a neutral axis of the single corrugation formed by the corrugation portions 82 and 92 between the hill 102 and the valley 100, as will be further described.

Figure 3:
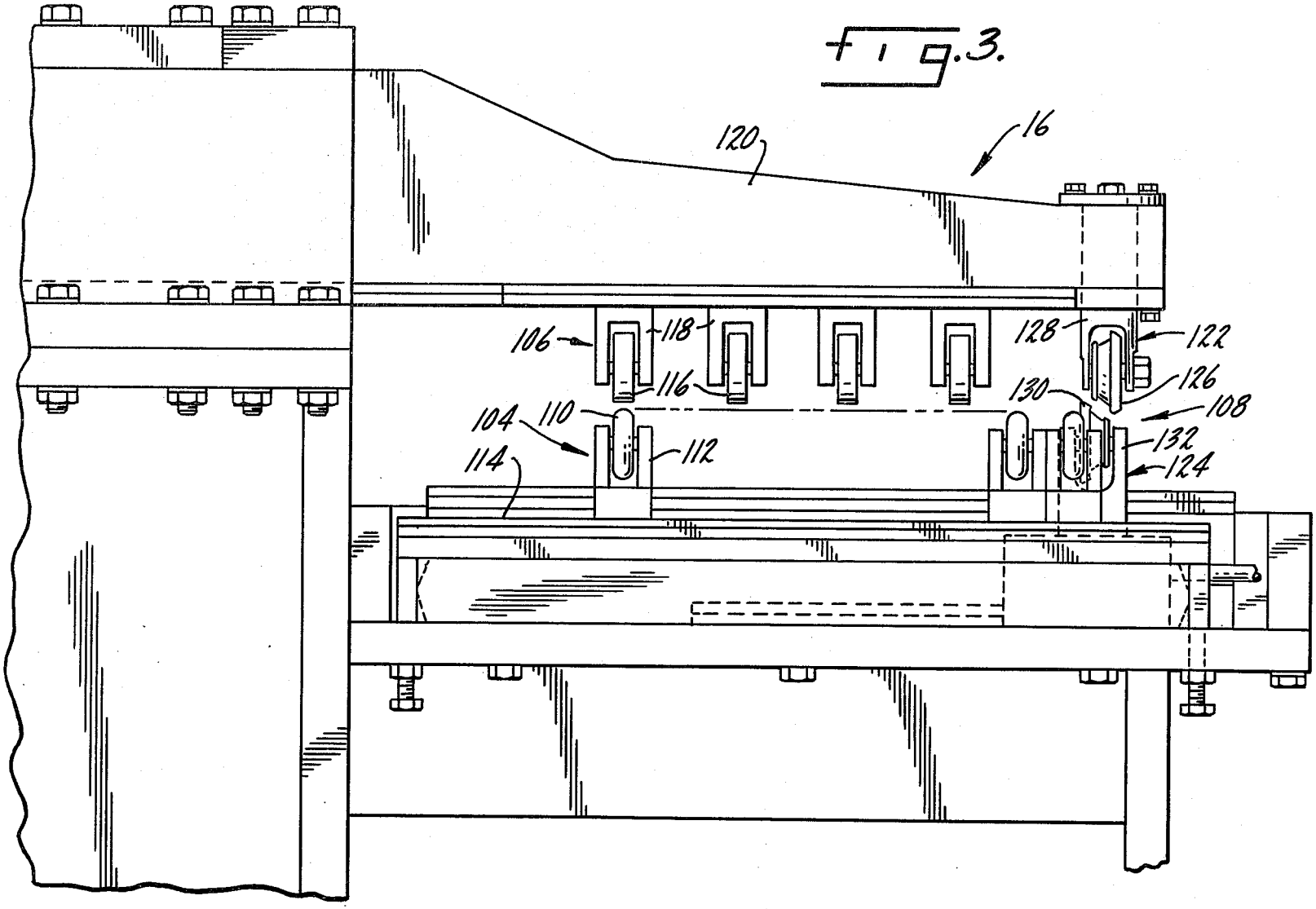
FIG. 3 is an enlarged front elevational illustration of the pipe forming device portion of the apparatus according to the invention.

Engagement of the flanges 86 and 96 is effected in the pipe forming device 16. Turning to FIG. 3, an enlarged portion of the pipe forming device 16 is illustrated, showing a lead roll assembly 104, a horn roll assembly 106, and a seaming roll assembly 108. A buttress roll assembly 105 is shown in FIGS. 1 and 2. The horn roll assembly 106 provides a bending axis about which the lead roll assembly 104 and buttress roll assembly cooperate to spiral the sheet 60 into helical convolutions. With the exception of the horn roll assembly 106, the pipe forming device illustrated in FIG. 3 is essentially the same as that illustrated in the applicant's U.S. Pat. No. 4,070,886 entitled "Spiral Pipe Forming Machine With Device For Aligning Spiralling Rolls," which is incorporated herein by reference. Further detail of the pipe forming device 16, which will not be described herein in detail, can be obtained from the applicant's said United States patent.

The lead roll assembly 104 is composed of a plurality of individual rollers 110 maintained within individual roller yokes 112 which are mounted for pivoting and horizontal sliding along a channel 114. The roller yokes 112 may be uninterconnected, as described in the applicant's U.S. Pat. No. 4,070,886, or may be interconnected in some manner, also as described in the applicant's foregoing U.S. patent. The roller yokes 112 are of a sufficient size to adequately space the rollers 110 to engage the underside surfaces of hills of the corrugations in the multi-layer sheet 60 as it enters the pipe forming device 16. For clarity of description, the sheet 60 has been eliminated from FIG. 3.

The horn roll assembly 106 is composed of a plurality of flat rollers 116 mounted in roller yokes 118 which are positioned for pivoting only in a horn member 120 of the pipe forming device 16. Although four such roller yokes 118 are illustrated in FIG. 3, it should be apparent that any number of roller yokes can be employed depending on the width of the multi-layer sheet entering the pipe forming device 16. Those shown are merely exemplary.

The seaming roll assembly 108 is composed of an upper lock seaming roll 122 and a lower lock seaming roll 124. The upper roll 122 includes a roller 126 contained within an adjustable yoke 128. The lower roll 124 includes a roller 130 which complements the shape of the roller 126 and which is mounted within a slideable yoke 132. Greater detail of the seaming roll assembly 108 can be obtained from the applicant's foregoing U.S. Pat. No. 4,070,886.

Illustrated in FIG. 8 is an enlarged broken view of the seaming rollers 126 and 130 completing a double lock seam 134 in a single corrugation 136 formed of the corrugation portions 82 and 92. The seam completing step shown in FIG. 8 is immediately downstream in the pipe forming operation from the flange engagement step shown in FIG. 7.

As illustrated in FIG. 8, the rollers 126 and 130 compress the flanges 86 and 96 to complete the double lock seam 134. At the same time, circumferential protuberances 138 and 140 located on the respective rollers 126 and 130 form heels 142 and 144 adjacent opposite sides of the double lock steam 134 to assure that the lock seam remains closed.

Illustrated in FIG. 9 is a broken sectional portion of a pipe 146 formed by the apparatus of the invention. The inner wall 148 of the pipe 146, composed of the curled second sheet 46, is generally smooth excepting the single corrugation 136 formed in the pipe at the juncture of adjacent helical convolutions. The lock seam 134 is formed on a neutral axis of the single corrugation 136 between the hill 102 and the valley 100. If desired, and although not illustrated, the apparatus of the invention can be modified to locate the lock seam 134 between the valley 100 and the hill 98, so long as the lock seam is located on a neutral axis of the single corrugation 136.

Also as illustrated in FIG. 9, all portions of the inner wall 148 between successive convolutions of the corrugation 136 rest upon hills 150 of the corrugated outer wall 152 of the pipe 146. Therefore, the inner surface of the pipe 146 formed by the apparatus 10, with the exception of the single corrugation 136, is smooth.

The purpose of the single corrugation 136 is to assure that the lock seam 134 is located on a neutral axis of the pipe 146 where stressive forces act along a line running between the hill 102 and the valley 100, tending to compress or extend the lock seam 134 at its strongest point, along the folded-over portions of the seam. As described above, the greatest strength for the lock seam is on the neutral axis between a corrugation hill and valley.

Although not illustrated in the drawings, it should be apparent that the pipe 146 may be formed of more than two layers of pipe material. Any number of layers may be used, so long as the inner wall of the pipe is generally smooth excepting the single corrugation, and the pipe includes a corrugated wall for load bearing strength.

The apparatus 10 according to the invention is operated in the following manner. After coils 18 and 20 are mounted on their respective spindles 22 and 24, the sheet 32 is drawn from the coil 18 and inserted within the corrugating roll 30 of the corrugating device 14. At the same time, the sheet 46 is withdrawn from the coil 20 and inserted within the guide modules 48 and 50. As the apparatus is operated, the sheets 46 and 32 join at the stand 62 forming the multi-layer sheet 60, and the corrugation portions 82 and 92, and lock seam flanges 86 and 96, are formed in the respective marginal edges 84 and 94 of the sheet 60. The sheet then proceeds into the pipe forming device 16, where the sheet is spiralled into adjacent, helical convolutions, the flanges 86 and 96 interengaged, and the lock seam 134 closed and the single corrugation 136 completed by the seaming roll assembly 108. The pipe is then cut to desired lengths by a suitable pipe severence apparatus (not illustrated), such as that disclosed in the applicant's U.S. Pat. No. 3,815,455.

I claim:

1. In an apparatus for continuously forming multi-layer pipe from plural elongated sheets of ductile material, the pipe having a corrugated exterior wall and a substantially smooth interior wall, and the apparatus having a rolling device for positioning the sheets in contiguous layers and driving the sheets, a pipe forming device for accepting the drive sheets and spiralling the layered sheets into successive, adjacent helical convolutions having a central axis formed at an oblique angle to the longitudinal axis of the layered sheets, and a seaming device to join adjacent helical convolutions, the improvement comprising:

a. first means in said rolling device for impressing continuous longitudinal corrugations in a first sheet forming the exterior wall of the pipe, b. second means in said rolling device for positioning a second flat sheet in a contiguous layer upon the first sheet, forming a multi-layer sheet, with the edges of said first and second sheets being generally coextensive, and c. means for forming a single, helical corrugation in the inner wall of the pipe, comprising i. first rolling means adjacent one marginal edge of said multi-layer sheet to shape therein a first portion of said single corrugation, said first rolling means including means to form a first partial lock seam element in said one marginal edge, ii. second rolling means adjacent the other marginal edge of said multi-layer sheet to shape therein a second portion of said single corrugation complementary to said first portion, said second rolling means including means to form a second partial lock seam element in said other marginal edge, iii. said first and second portions being joined by said seaming device to form said single corrugation.

2. The apparatus according to claim 1 in which said pipe forming device comprises first, second and third horizontally disposed forming rolls, each of said rolls comprising a plurality of adjacent roller elements, the peripheries of each of said plurality of roller elements engaging one surface of said multi-layer sheet along a series of points generally parallel to the central axis of the helical convolutions.

3. The apparatus according to claim 2 in which the individual roller elements of said first and third rolls engage the corrugated first sheet of the multi-layer sheet and the individual roller elements of said second roll engage the second flat sheet of the multi-layer sheet, said second roll providing a bending axis about which said first and third rolls cooperate to spiral the multi-layer sheet into said helical convolutions.

4. The apparatus according to claim 3 in which the individual roller elements of said second roll are pivotally mounted and the individual roller elements of said first and third rolls are pivotally mounted and movable longitudinally along a line parallel to said central axis.

5. The apparatus according to claim 1 in which said lock seam elements are positioned along said first and second portions of said single corrugation such that said seaming device forms said lock seams elements into a double lock seam located on a neutral axis of said single corrugation.

6. An apparatus for continuously forming multi-layer helical pipe from a plurality of elongated, contiguous sheets of material, the pipe having a corrugated exterior wall and a substantially smooth interior wall having a single, helical corrugation, comprising:

a. rolling means mounted in a carriage for impressing continuous longitudinal corrugations in a first sheet forming the exterior wall of the pipe, b. at least one guide means for guiding a second flat sheet into contiguous abutment with one surface of said first corrugated sheet to form a multi-layer sheet, with the edges of said first and second sheets being generally coextensive, c. means adjacent one marginal edge of said multi-layer sheet to shape a first portion of the single corrugation, said means adjacent one marginal edge including means to form a first partial lock seam element in said one marginal edge, d. means adjacent the other marginal edge of said multi-layer sheet to shape a second portion of the single corrugation complementary to said first portion, said means adjacent the other marginal edge including means to form a second partial lock seam element in said second marginal edge, e. means for spiralling said multi-layer sheet into adjacent, helical convolutions having said second sheet forming an inner wall and said first sheet forming an outer wall, and having said first and second portions abutting to form said single corrugation, and f. means for joining said adjacent convolutions.

7. The apparatus according to claim 6 in which said guide means includes a pair of pinch rolls located on opposite sides of said second sheet and a pair of edge guide rolls located at opposite edges of said second sheet, said pinch and guide rolls maintaining said second sheet vertically and laterally stable.

8. The apparatus according to claim 7 in which said edge and guide rolls are mounted in a framework, said framework being removably mounted in said carriage.

9. In an apparatus for continuously forming a multi-layer sheet from a plurality of elongated, continuous sheets of material, the apparatus having sources of first and second elongated sheets, a rolling device for forming longitudinal corrugations in the first sheet, and a device for guiding the second sheet into contiguous abutment with the corrugated first sheet, the improvement comprising:

the guiding device including at least one module removably mounted in said rolling device, said module comprising a framework having mounted therein a pair of elongated pinch rolls positioned on opposite sides of the second sheet and a pair of edge guide rolls positioned at opposite edges of the second sheet, said pinch and guide rolls being located to maintain the second sheet vertically and laterally stable.

10. The apparatus according to claim 9 including means for forming first and second complementary portions of a single corrugation in opposite marginal edges of said multi-layer sheet.

11. The apparatus according to claim 10 including means for spiralling said multi-layer sheet into adjacent, helical convolutions and further including means for joining said adjacent convolutions along said single corrugation.

12. A method of continuously forming multi-layer pipe from plural elongated sheets of material, the pipe having a helically corrugated exterior wall and a substantially smooth interior wall having a single, helical corrugation, including the steps of a. fashioning continuous longitudinal corrugations in a first sheet positioned for forming the exterior wall of the pipe, b. forming a multi-layer sheet by positioning a second flat sheet in a contiguous layer upon the first sheet with the edges of said first and second sheets being generally coextensive, c. shaping a first portion of said single corrugation in one marginal edge of said multi-layer sheet and shaping a first partial lock seam element in said one marginal edge, d. shaping a second portion of said single corrugation in the other marginal edge of said multi-layer sheet and shaping a second partial lock seam element in said other marginal edge, e. spiralling said multi-layer sheet into successive, adjacent helical convolutions having said first and second portions abutting to form said single corrugation, and f. joining the edges of said convolutions at the juncture of said abutting first and second portions by forming said partial lock seam elements into a helical seam located in said single corrugation.

13. The method of forming multi-layer pipe according to claim 12 in which said first and second portions are formed in the third-and fourth-recited steps such that said helical seam is located on a neutral axis of said single corrugation.

14. The method of forming multi-layer pipe according to claim 13 in which the step of joining the marginal edges includes the steps of interengaging the partial lock seam elements and completing a lock seam by compressing the interengaged lock seam elements into a double lock seam located on a neutral axis of said single corrugation.

* * * * *